US007171707B2

(12) United States Patent
Landay

(10) Patent No.: US 7,171,707 B2
(45) Date of Patent: Feb. 6, 2007

(54) PORTABLE ROLLUP PACK

(75) Inventor: Lisa A. Landay, San Clemente, CA (US)

(73) Assignee: Gem & I Products, Inc., San Clemente, CA (US)

( * ) Notice: Subject to any disclaimer, the term of this patent is extended or adjusted under 35 U.S.C. 154(b) by 0 days.

(21) Appl. No.: 11/134,962

(22) Filed: May 23, 2005

(65) Prior Publication Data

US 2006/0260046 A1 Nov. 23, 2006

(51) Int. Cl.
*A47G 9/08* (2006.01)
*B65D 30/00* (2006.01)
*B65D 33/00* (2006.01)

(52) U.S. Cl. ..... 5/413 R; 383/4; 383/16; 383/39; 383/106; 190/2; 224/156

(58) Field of Classification Search ..... 5/413 R, 5/413 AM, 417–420; 383/4, 39, 106, 16; 224/156, 153; 190/1, 2
See application file for complete search history.

(56) References Cited

U.S. PATENT DOCUMENTS 1,269,276 A * 6/1918 Harris ..... 383/4
2,679,877 A * 6/1954 Leggett ..... 383/39
4,562,952 A * 1/1986 Chinman ..... 229/87.15
4,587,682 A * 5/1986 Schultz ..... 5/413 R
D289,228 S * 4/1987 Chinman ..... D3/299
4,881,684 A * 11/1989 Chinman ..... 190/115
4,967,986 A * 11/1990 Schildkraut ..... 224/250
5,287,571 A * 2/1994 Rademacher ..... 5/413 R
5,622,300 A 4/1997 Robinson
5,743,649 A * 4/1998 Gonzalez ..... 383/6
6,061,849 A * 5/2000 Seals ..... 5/417
6,193,034 B1 * 2/2001 Fournier ..... 190/107
6,543,072 B2 4/2003 Hsu
7,028,870 B2 * 4/2006 Valdez-Campbell ..... 224/153

* cited by examiner

*Primary Examiner*—Alexander Grosz
(74) *Attorney, Agent, or Firm*—Advantage IP Law Firm

(57) ABSTRACT

A portable rollup pack for organizing, storing, and transporting personal articles including a sleeping bag for an extended stay is provided in an elongated bag body having a central carrying section and laterally positioned flexible wing wraps with the body having a compartmentalized interior surface region and an exterior surface with fasteners and carrying handles such that the bag body may receive personal articles in the compartmentalized region and then be wrapped about a cylindrically shaped sleeping bag and transported as an integral unit.

19 Claims, 5 Drawing Sheets

PORTABLE ROLLUP PACK

BACKGROUND OF THE INVENTION

1. Field of the Invention

The present invention relates to an apparatus for transporting personal articles and more specifically to carry packs for organizing, storing, and transporting substantially flattened or compressible articles along with rolled up cushioning articles such as sleeping gear, exercise and seating mats, towels and other rolled up articles.

2. General Background and State of the Art:

Adults as well as children often engage in overnight camping trips as well as slumber parties. For such extended stays, the overnighter generally must pack both a sleeping bag and a personal carrying pack. Typically, any personal items are stored in a carrying pack such as a school backpack or knapsack that is transported on the individual's back or hand-carried. The sleeping bag is also generally rolled up into a bulky cylindrical package and lugged under one arm or otherwise carried by a handle. Thus, even with the carrying pack worn on the back, this transportation method occupies at least one arm and takes up a significant amount of space. While the size of some backpacks allows the user to compress the sleeping bag into the bottom of the pack, this is not practical for many of the larger, less compressible sleeping bags commonly used on overnight trips. In addition, the sleeping bag is typically stored at the bottom of the pack and is not readily accessible without removing the entire contents of the pack.

In U.S. Pat. No. 6,543,072 to Hsu an integrated knapsack and sleeping bag combination is described in an attempt to reduce some of this transportation concern. However, the sleeping bag in this combination is connected to the lining of the knapsack and thus does not facilitate cleaning the sleeping bag or replacing the sleeping bag once it is outgrown or degrades so as to be no longer useful.

Another solution for carrying personal items is described in U.S. Pat. No. 5,622,300 to Robinson. This patent describes a roll pack for transporting articles to the beach or a picnic area. The roll pack described in this patent describes a set of pockets along one edge for storing articles including a pillow and a set of pockets along the opposite edge for storing a set of tie wraps so as to prevent the hook and loop fasteners from becoming fouled with dirt or other contaminants. The majority of the roll pack is taken up by a large intermediate section made up of an absorbent material such as terry cloth. This central enlarged section is provided for use as a towel so that the user does not need to bring a separate towel. By providing such a large towel section, this roll pack configuration wastes a considerable amount of useable storage space. Moreover, it would be impractical to store articles up against the wet towel section as such articles could absorb the towel moisture and become damaged.

Thus, there exists a need for rollup pack for maximizing storage space while transporting a rolled up article such as a sleeping bag in a manner so as to free the user's hands during transportation.

INVENTION SUMMARY

In accordance with a preferred embodiment of the present invention, a rollup pack for organizing, storing and transporting articles for extended stays and for use with a cushioning object such as a sleeping bag rolled up into a cylindrical configuration is provided in an elongated bag body with exterior and interior surfaces and a central carrying section disposed between two flexible laterally disposed wings that may include a pair of complementary fastener elements for releasably securing the wings about the rolled up sleeping bag. The interior surface of the bag body may include a plurality of pockets that may span a substantial length of the bag body and are placed against the sleeping bag when the rollup pack is secured about the sleeping bag. A pair of carrying straps facilitates transporting the rollup pack and sleeping bag together as single unit as a backpack thus freeing the user's hands during transport.

In another aspect of the present invention, the pockets span a substantial length of the bag body and may include fold wells between pockets to accommodate folding the bag body about the sleeping bag.

Another feature of the present invention is the provision of a waterproof interior surface or pocket and a viewing window to ascertain contents of the pocket without having to completely empty the pocket.

Yet another feature of the present invention is the incorporation of pocket opening parallel to the side edges of the bag body and facing inwardly to reduce the likelihood of inadvertent removal or spilling out of the pocket.

Other aspects of the present invention will become apparent with further reference to the following drawings and specification.

DETAILED DESCRIPTION OF THE PREFERRED EMBODIMENTS

Figure 1:
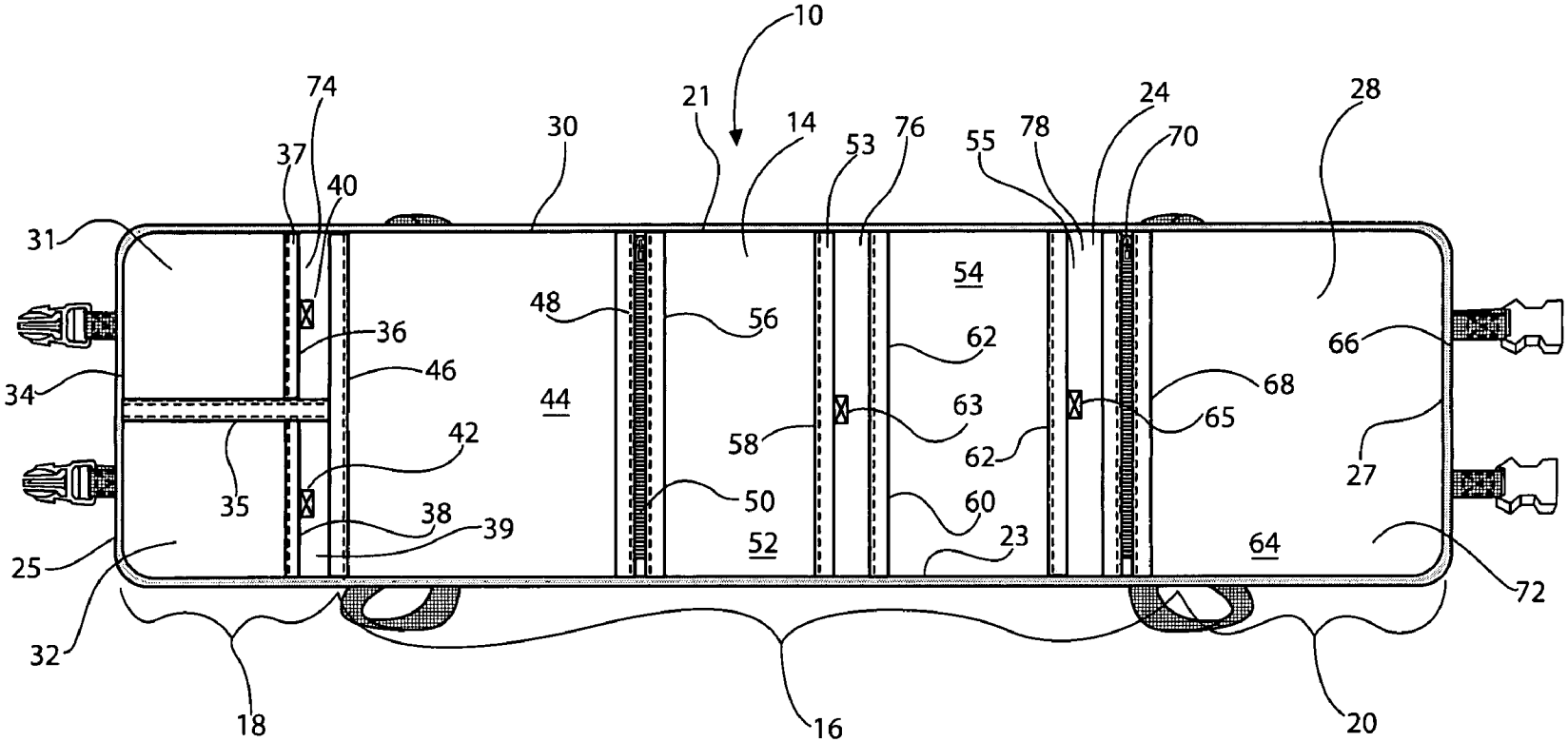
FIG. 1 is an elevational view of an interior surface of a rollup pack in accordance with one embodiment of the present invention.
Figure 2:
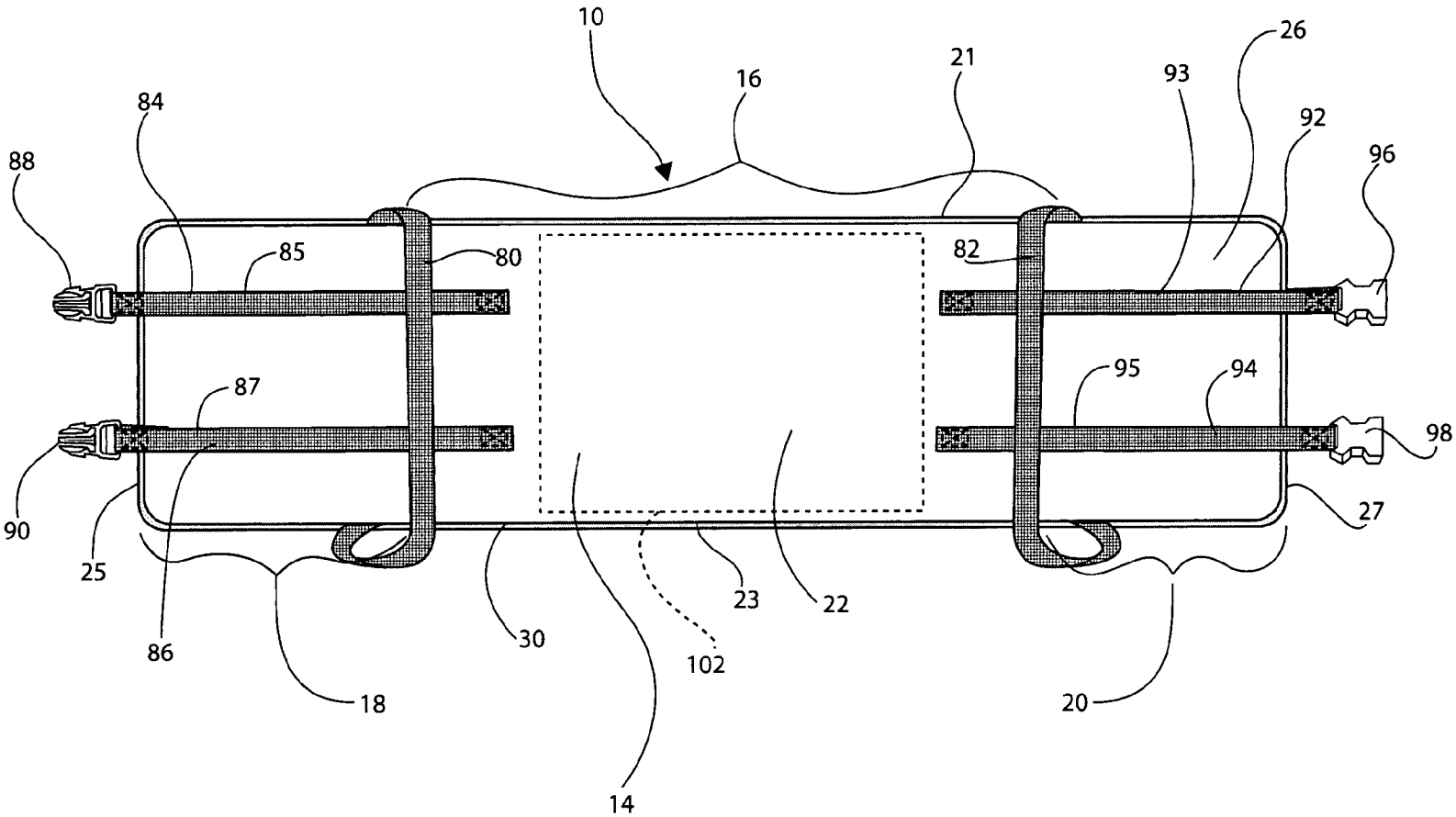
FIG. 2 is a reverse elevational view of an exterior surface of the rollup pack of FIG. 1.
Figure 3:
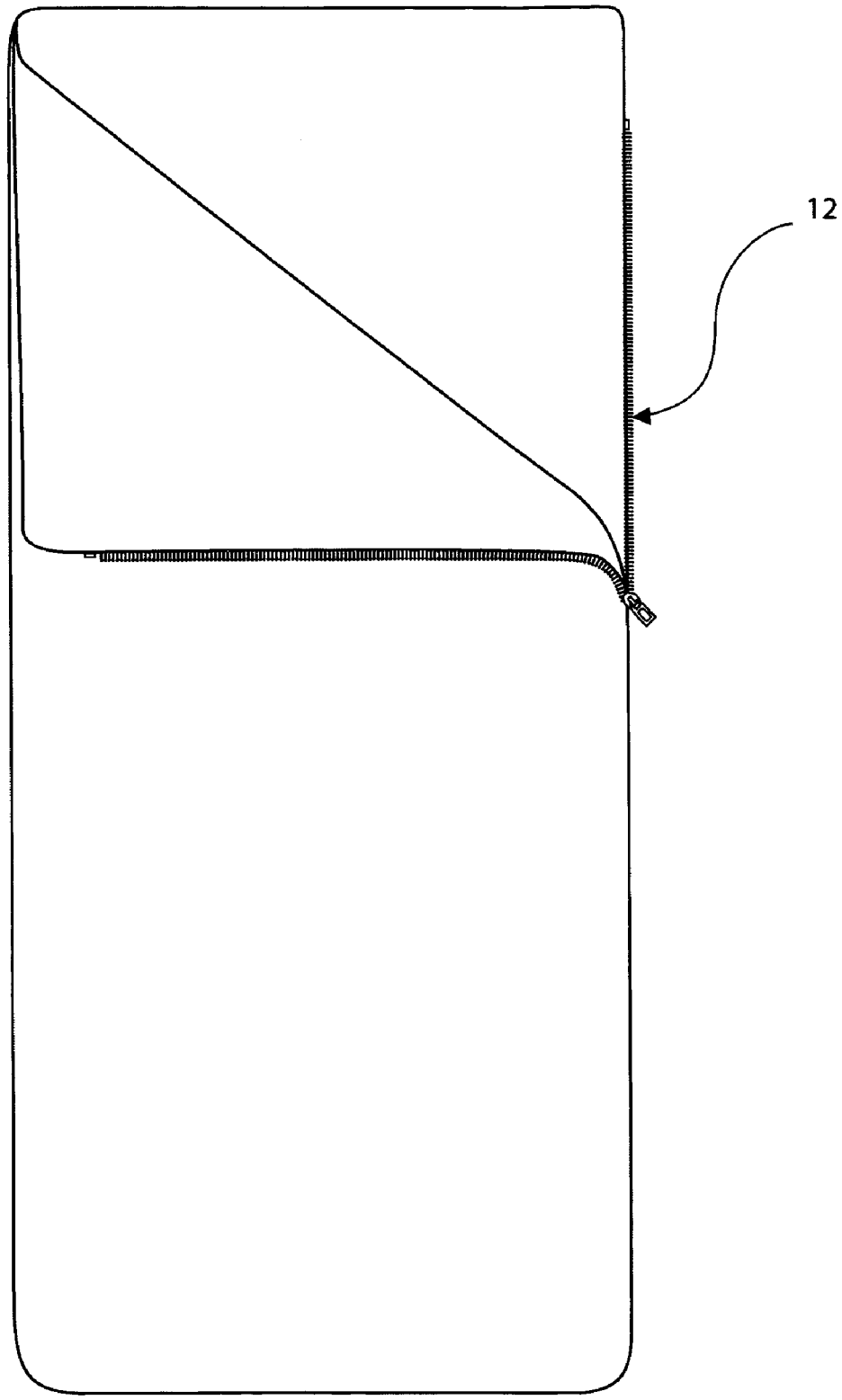
FIG. 3 a top view of an unrolled, partially open, conventional sleeping bag for use with the rollup pack of FIG. 1.

Referring now to FIGS. 1–2 illustrating interior and exterior views of an exemplary portable rollup pack in accordance with the present invention and generally designated 10, the rollup pack is provided for organizing, storing, and transporting personal articles, items, or objects including a rolled up sleeping bag for extended stays. An exemplary sleeping bag, generally designated 12, is illustrated in FIG. 3. When laid flat as in FIGS. 1–2, the rollup pack 10 generally includes a substantially rectangular bag body 14 that may be divided generally into a medial carrying section 16 interposed between a left lateral wing wrap 18 and a right lateral wing wrap 20. The bag body is constructed of an outer layer of fabric 22 sewn to a similarly dimensioned inner layer of fabric 24 forming an exterior bag body surface 26 and interior bag body surface 28, respectively. The top edge 21, bottom edge 23, left hand edge 25, and right hand edge 27 of the bag body are then finished off with conventional ¼ inch filled piping 30 circumscribing the perimeter of the bag body. In this exemplary embodiment, the overall height of the bag body measured from the top edge 21 to the bottom edge 23 is approximately 12.5 inches and the overall length is approximately 45 inches measured from the left hand edge 25 to the right hand edge 27 as viewed in FIG. 1.

With continued reference to FIG. 1, the interior surface 28 of the bag body 14 may be divided into a number of pockets for organizing, storing, and transporting personal articles. In this exemplary embodiment, the bag body includes six pockets arranged across substantially the entire length and height of the bag body as viewed in FIG. 1. The leftmost upper pocket 31 and lower pocket 32 are vertically stacked and span the entire height of the bag body. In this exemplary embodiment, these dual pockets subdivide the height of the bag body equally. These dual pockets include a common bottom edge 34 that corresponds with the leftmost edge 25 of the bag body as viewed in FIG. 1. The dual pockets also share a common sidewall 35. Each pocket 31, 32 includes a vertically projecting top edge 36, 38, respectively, forming an opening into the respective pocket. The openings face the right hand end 27 of the bag away from the left hand edge 25. The top edges of the pockets 31, 32 may be lined with a conventional hook and loop type closure as indicated by strips 37, 39, respectively, to seal off the contents of the pocket. A convenient pull tab 40, 42 is provided on each pocket 31, 32, respectively, to facilitate separating the hook section from the loop section to gain access to the pocket.

These dual pockets 31 and 32 are typically dimensioned to accommodate smaller personal articles. In this exemplary embodiment, these pockets measure approximately 7.5 inches in depth from the bottom edge 34 of each pocket to the top opening edge 36 or 38, respectively. Depth is generally defined as the distance from the bottom edge of a pocket to a top open edge of a pocket. To the immediate right of the dual pockets 31 and 32, a first enlarged pocket 44 is provided. The bottom edge 46 of this pocket is located proximate the openings of the dual pockets 31 and 32. This enlarged pocket 44 spans the entire height of the bag body 14 and measures approximately 14 inches in depth. As with the dual pockets, the first enlarged pocket is provided with a top edge 48 providing an opening facing the right hand end 27 of the bag body 14. A closure device in the form of a nylon zipper 50 may be used to seal off this pocket.

With continued reference to FIG. 1, spaced to the right of the first enlarged pocket 44 is a pair of intermediate pockets 52 and 54. These pockets are constructed identically and each measure about 4.75 inches in depth and span the entire height of the bag body 14. The bottom edge 56 of the first intermediate pocket 52 is conjoined with the top edge of the zipper closure 50. The top edge 58 of the first intermediate pocket faces the right hand end 27 of the bag body. The second intermediate pocket 54 includes a bottom edge 60 spaced to the right of the top edge of the first intermediate pocket and an opening 62 that faces the right hand edge of the bag body as well. In this example, each of the intermediate pockets 52, 54 incorporate hook and loop closures as indicated by strips 53, 55, respectively, to seal off their respective contents. As with the dual pockets 31, 32, each intermediate pocket includes a pull tab 63, 65 respectively to assist in separating the hook and loop closures lining the opening of the intermediate pockets.

Still referring to FIG. 1, the rightmost pocket 64 is a second enlarged pocket and includes a bottom edge 66 corresponding with the right hand edge 27 of the bag body 14. Unlike the other pockets, the top opening 68 of this pocket faces to the left hand side 25 of the bag body, as viewed in FIG. 1. The second enlarged pocket includes a zipper closure 70 for controlling access to the pocket compartment. The second enlarged pocket 64 also spans the entire height of the bag body and measure approximately 11 inches in depth in this exemplary pocket configuration.

The pockets 31, 32, 44, 52, 54, and 64 may be formed by sewing, adhering, welding or using other suitable joining techniques to join the three sides of a substantially rectangular plastic sheet or sheets to the interior surface 28 of the bag body 14. As described above, a fourth edge of the plastic sheet forms an opening into the respective pocket compartments that may be closed using conventional closure devices such as plastic or metal zippers, hook and loop closures, buttons, snaps, and other suitable closure device. It is not necessary to use a closure device however. It is preferable to use clear plastic sheets to form a viewing window, such as exemplified by reference numeral 72 (FIG. 4), so that the contents of the pocket may be easily ascertained without having to open the pocket and remove the contents one at a time until the desired article is retrieved. Other suitable materials may be used as well and the viewing window may comprise the entire pocket wall or a portion thereof. To maximize the storage capacity of the bag body, it is also preferable to provide pockets across the entire width and height of the bag body 14. However, other pocket configurations will occur to one of ordinary skill in the art. In this example, all of the pocket openings are configured substantially parallel to the left and right hand edges 25, 27, respectively, of the bag body.

The pockets may be spaced apart from one another to accommodate folding of the bag body 14 as well. For instance, there are three folding wells in this exemplary bag body 14 as illustrated in FIG. 1. The first or leftmost folding well 74 is spaced between the top edges 36, 38 of the dual pockets 31, 32, respectively, and the bottom edge 46 of the first enlarged pocket 44. An intermediate folding well 76 is interposed between the top edge 58 of the first intermediate pocket 52 and the bottom edge 60 of the second intermediate pocket 54. The rightmost or third folding well 78 is positioned between the opening 62 of the second intermediate pocket 54 and the zipper closure 70 of the second enlarged pocket 64. In this example, these wells span the entire height of the bag body and measure about 1.5 inches across. These wells provide fold lines that accommodate folding the bag body even when the individual pockets are relatively full and may resist folding themselves.

It is also preferable to construct the bag body 14 from waterproof materials or at least highly water resistant materials such as nylon, polyester, or other suitable material. As an alternative, the materials or fabrics used to construct the bag body may be treated with a waterproofing substance. This prevents personal articles that may leak from spreading to the remainder of the bag body or sleeping bag 12 when the rollup pack is in contact with the bag. In addition, a wet towel may be placed in one the pockets without concern of dampening the other articles or sleeping bag. By providing a waterproof exterior surface 26, the items in the pockets and sleeping bag are further protected from exterior moisture. In addition, if the contents of the bag body 14 are removed or there is no concern if they are compressed, the rollup pack may be used as a mat underneath the sleeping bag 12 when unrolled further protecting the sleeping bag and providing an insulating surface beneath the sleeping bag.

Referring now to FIG. 2, on the exterior surface 26 of the bag body 14 includes a pair of carrying handles 80 and 82. The ends of each carrying handle are sewn to the top edge 21 and bottom edge 23 of the bag body 14. These carrying handles are approximately 22 inches in length to provide ample length for use as shoulder straps in addition to be used as carrying handles. In this exemplary embodiment, the shoulder straps 80 and 82 are spaced approximately 8.75 inches from the respective left end 25 and right end 27 of the bag body 14. The handles may be adjustable using a conventional shoulder strap adjustment construction. The shoulder straps are preferably constructed of a webbed strapping and may be padded. In general, the shoulder straps divide the intermediate carrying section 16 from the lateral wings 18 and 20, respectively. However, this division is for ease of description and not meant to be limiting in any manner.

With continued reference to FIG. 2, a first pair of pack fasteners 84, 86 is sewn into the exterior surface 26 of the bag body 14. The pack fasteners 84 and 86 include a length of webbed strapping 85, 87, respectively, measuring approximately 10.75 inches in length from an interior end fastened to the exterior surface 26 within the intermediate carrying section 16 to the left hand edge 25 of the bag body 14. Each fastener 84, 86 projects approximately 1–2 inches beyond the left most edge 25 of the bag body and terminates in a plastic clip 88, 90, respectively, of the dual bayonet variety. The fasteners 84 and 86 are spaced apart approximately 6.5 inches along the height of the bag body. The strap portions 85 and 87 of the fasteners are constructed from a similar webbed strapping material as the shoulder straps 80 and 82.

With continued reference to FIG. 2, on the right hand side of the bag body 14 is a second pair of pack fasteners 92, 94 constructed in a similar manner to the first pair of pack fasteners 84, 86 with a strap section 93, 95, respectively, sewn into the exterior surface 26 of the bag body. The ends of the pack fasteners 92, 94 project approximately 1–2 inches beyond the right hand edge 27 of the bag body and terminate in a plastic buckle 96, 98, respectively, for fastening to the clips 88, 90 of the first pair of pack fasteners when the wings 18 and 20 are brought together. As viewed in FIG. 2, upper first fastener 84 is aligned with upper second fastener 92 along the height of the bag body when the bag body is rolled out flat. Lower first fastener 86 is aligned with lower second fastener 94 in a similar configuration. These fastener pairs may be adjustable as well to accommodate a variety of sleeping bag dimensions. This exemplary embodiment describes a two pair of pack fasteners in the form of a clip and buckle. It will be appreciated that other suitable releasable fastening devices may be used as well including hook and loop closures, snaps, buttons, rings, clamps, hooks and grommets, or loose tie ends.

Figure 4:
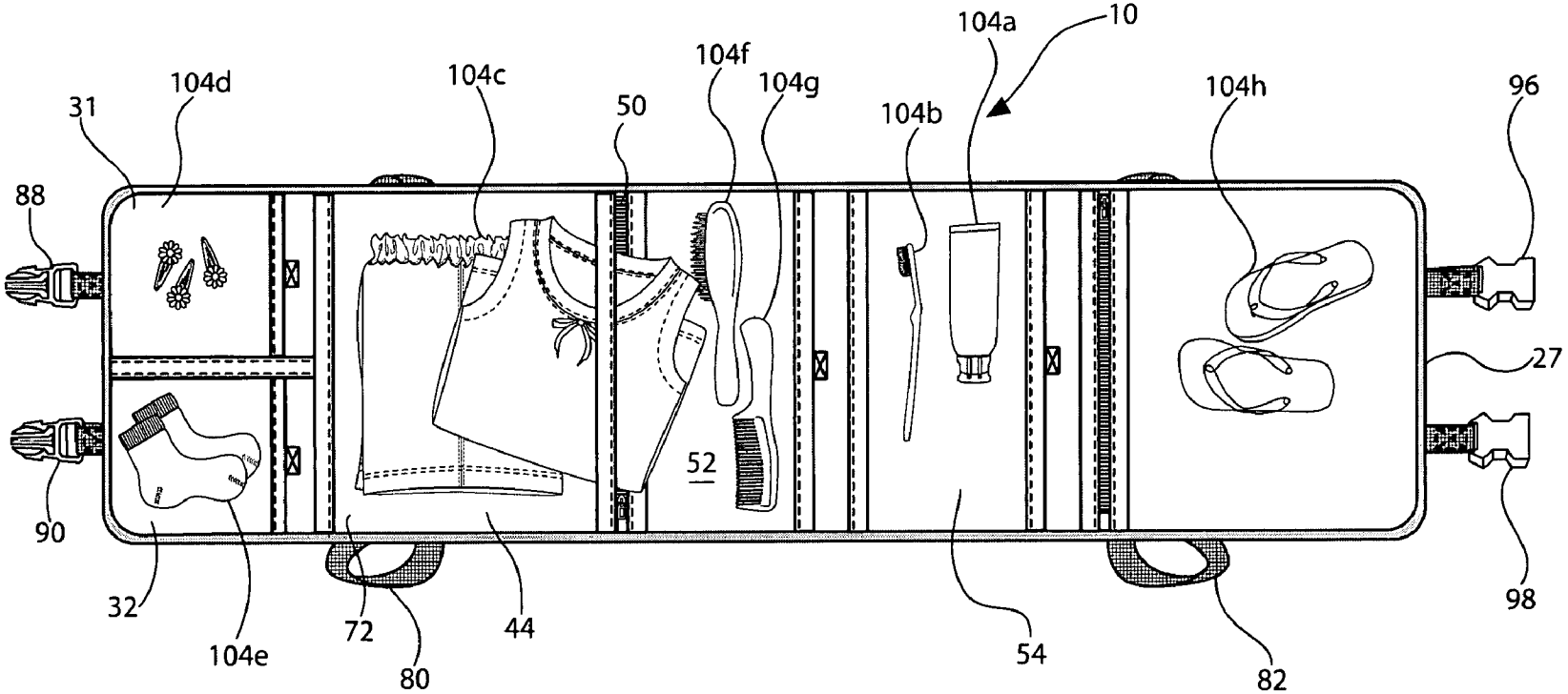
FIG. 4 is an elevational view illustrating various articles being stored within the pockets of the rollup pack of FIG. 1.

With reference now to FIGS. 1–4, in use, the rollup pack 10 is laid out flat on a bed or other convenient flat surface. The user may then grasp the tabs 40, 42, 63, 65 of the desired pocket 31, 32, 52, and 54, respectively, to separate the hook and loops and closures or unzip the zipper closures 50, 70, of the enlarged pockets 44, 64, respectively, to open the desired pocket 30, 32, 44, 52, 54, and 64 insert extended stay articles such as clothing, footwear, toiletries, snacks, reading materials, and other suitable items to be taken on an overnight trip in a manner of organization as befitting the user. Exemplary articles such as a toothpaste tube 104*a*, toothbrush 104*b*, pajamas 104*c*, hairclips 104*d*, socks 104*e*, brush 104*f*, comb 104*g*, and sandals 104*h* are illustrated in FIG. 4. When the desired overnight articles have been inserted into the pockets, the opening of the pockets are closed by mating the hook and loop closures or zipping the zipper closures where appropriate.

Figure 5A:
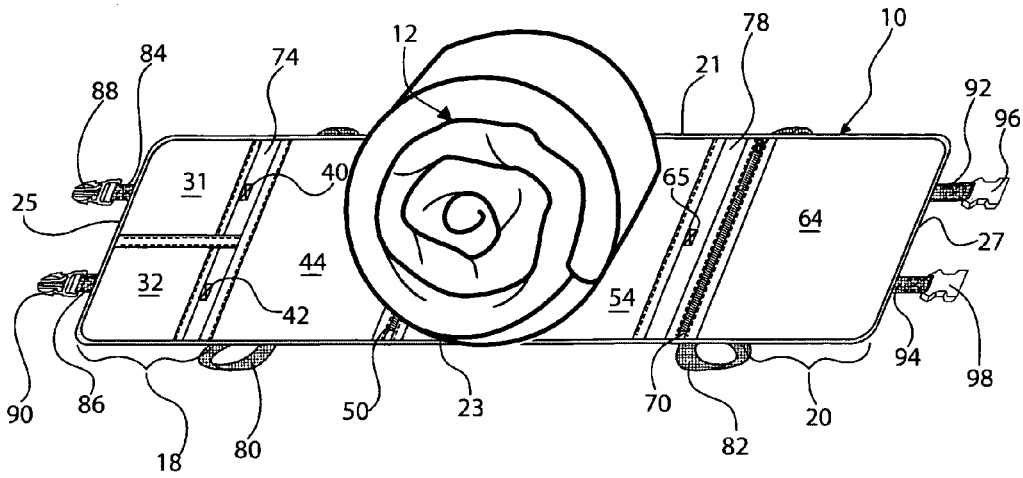
FIGS. 5A–5C is a set of perspective views illustrating the packing of the sleeping bag and rollup pack of FIG. 1 to prepare for their transport as an integrated unit.
Figure 5B:
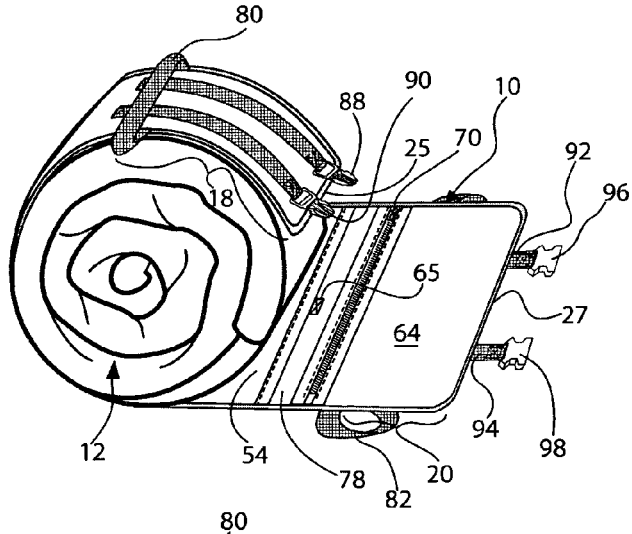
Figure 5C:
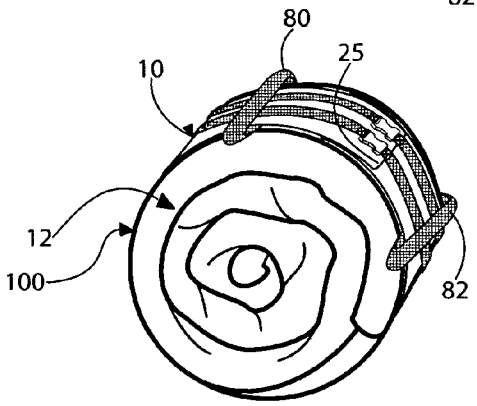

Turning now to FIGS. 5A–5C, the user may then roll up the sleeping bag 12 into a cylindrical configuration such as illustrated in FIG. 5A and place the rolled up sleeping bag on top of the interior surface 28 of the bag body 14 of the rollup pack 10 about the middle of the bag body. The flat ends of the sleeping bag are generally aligned with the top edge 21 and bottom edge 23 of the bag body but may extend beyond or fall short of the edges as determined by the relationship of the rolled up sleeping bag height in relation to the rollup pack height. The user may then grasp the left wing 18 by the left hand end 25 and fold it on top of the sleeping bag to partially wrap the wing about the circumference of the sleeping bag. Even with the pockets being filled to capacity and possibly resistant to bending, the left wing will fold about the well 74 onto to the sleeping bag and generally follow the curvature of the sleeping bag. Then, the user may grasp the right hand edge 27 of the bag body and bring the right wing 20 and its buckles 96, 98 proximate their respective counterpart clips 88, 90 of the first pair of pack fasteners 84, 86, respectively. Clip 88 is then inserted into buckle 96 and clip 90 is inserted into buckle 98. This action secures the left wing 18 to the right wing 20 and secures the sleeping bag 12 within the rollup pack 10 to from an integral unit, generally designated 100, for transportation as illustrated in FIG. 5C. The right wing may be inserted above or below the left wing about the sleeping bag as long as the fasteners are exposed and may be coupled together. Preferably, the wings overlap when the ends of the rollup pack are fastened together so that there are no gaps around the circumference of the sleeping bag (FIG. 5C). This is facilitated by attaching the fastener straps at their extreme inner ends (X-patterns in FIG. 2) to the exterior surface 26 of the rollup pack 10 while leaving the remainder of each strap length unattached to the rollup pack. The fastener straps may be adjusted as necessary to tighten the rollup pack 10 about the sleeping bag 12. Given the adjustability of the straps, it is not necessary to roll up the sleeping bag the same way every time and a variety of sleeping bags may be accommodated. The user may then don the rollup pack unit 100 as one would a backpack by slipping left and right arms through the corresponding shoulder straps 80 and 82 and carry the integrated unit 100 on the user's back. Alternatively, the user may grasp both straps with one hand and carry as a piece of luggage.

Once the integrated unit 100 has been transported to the desired destination, the user may set the unit on a relatively elongated flat surface and separate clip 88 from buckle 96 and separate 90 from buckle 98. The user may then peel back the right wing 20 from the left wing 18 exposing the sleeping bag 12 and laying the rollup pack 10 flat. The sleeping bag may then be moved off to a side and the contents of the rollup pack 10 accessed as desired. The viewing windows 72 of each pocket facilitate the removal of the desired articles 104*a*, 104*b*, 104*c*, 104*d*, 104*e*, 104*f*, 104*g*, 104*h* in an organized manner.

It will be appreciated that the interior facing pockets 30, 32, 44, 52, 54, and 64 and sleeping bag 12 cooperate to cushion the articles stored in the rollup pack during transportation. In addition, the vertical and inwardly facing openings of each pocket reduce the likelihood of any articles falling out of a pocket during transport. The interior facing pockets also reduce the likelihood of theft of important articles during transport.

Instead of a sleeping bag 12, a beach towel, rolled up cushion, mat or other similar cushioning article may be rolled up into a substantially cylindrical configuration and the rollup pack secured around the towel for carrying articles to the beach, gym, or other location.

While the present invention has been described herein in terms of a number of preferred embodiments, it will be appreciated that various changes and improvements may also be made to the invention without departing from the scope and spirit thereof. For example, in this exemplary embodiment, the rollup pack is described as being flexible throughout its length. However, the medial section may include a rigid insert 102 (FIG. 2) or be formed of a formed foam or other cushioning material to conform to the user's back and the curved sleeping bag with the wing wraps remaining flexible to wrap about the substantially cylindrical object being transported.

What is claimed is:

1. A portable rollup pack for use with a sleeping bag rolled into a cylindrical configuration comprising:

an elongated, substantially rectangular bag body including an exterior surface and an interior surface and defining a medial carrying section and two laterally disposed flexible storage wings operable to wrap about said rolled up sleeping bag;

a first fastener element having at least a portion on said exterior surface of one of said wings;

a second complementary fastener element having at least a portion on said exterior surface of the other of said wings and operable to couple with said first fastener element when said wings are brought together;

pockets disposed on said interior surface of said storage wings and at least one intermediate pocket on said interior surface in said medial carrying section, said pockets including openings with closures parallel to at least one side of said bag body, at least one of said pockets being constructed from a substantially waterproof material, and having a viewing window, said pockets constructed to receive substantially flattened or compressible articles; and at least one carrying strap fastened to said exterior surface whereby a user may place articles into said pockets and said wings of said bag body rolled up with said interior surface abutting a circumference of said rolled up sleeping bag and said fastener elements fastened enabling the transportation of said bag body and sleeping bag as a unit while cushioning said articles with said sleeping bag.

2. The portable rollup pack as set forth in claim 1 wherein:

said bag body is flexible throughout its length.

3. The portable rollup pack as set forth in claim 2 further including:

a fold well spaced between a pocket in one of said wings and a pocket in said medial carrying section.

4. The portable rollup pack as set forth in claim 1 further including:

a sleeping bag rolled up into a substantially cylindrical configuration and wrapped within said wings of said rollup pack.

5. The portable rollup pack as set forth in claim 1 wherein:

said first and second fastener elements are a clip and a buckle; and said bag body includes two shoulder straps connected to said exterior surface with one of said shoulder straps operating as said at least one carrying strap.

6. The portable rollup pack as set forth in claim 1 wherein:

said interior surface of said bag body and said pockets are constructed of a non-absorbent material.

7. The portable rollup pack as set forth in claim 1 wherein:

said interior surface includes a first pair of pockets vertically stacked on one of said wings.

8. The portable rollup pack as set forth in claim 1 wherein:

said bag body includes a first edge and a second edge; and said interior surface defines a storage region including a plurality of pockets substantially spanning a length of said bag body and having openings parallel to said edges.

9. The portable rollup pack as set forth in claim 8 wherein:

said medial carrying section includes two oversized pockets with zipper closures and a second pair of pockets having hook and loop closures.

10. The portable rollup pack as set forth in claim 1 wherein:

at least one of said pockets includes a transparent surface defining a viewing window.

11. The portable rollup pack as set forth in claim 1 wherein:

said carrying strap is constructed of a webbed material and is adjustable.

12. The portable rollup pack as set forth in claim 1 wherein:

said first fastening element is connected to said exterior surface and includes a stretchable length of material terminating in a buckle.

13. The portable rollup pack as set forth in claim 1 wherein:

said carrying strap is operable to be gripped by hand to carry said bag body when said rollup pack is placed into a rolled up configuration with both of said wings brought together and fastened together.

14. The portable rollup pack as set forth in claim 1 wherein:

said bag body is constructed to lay substantially flat when unrolled and empty of articles.

15. The portable rollup pack as set forth in claim 1 wherein:

at least one of said pockets includes a closure device; and said closure is selected from the group consisting of a zipper and hook and loop fastening elements.

16. The portable rollup pack as set forth in claim 1 wherein:

said bag body includes a marginal edge finished off with a piping.

17. The portable rollup pack as set forth in claim 1 wherein:

said first fastener is a set of two clips attached to said exterior surface and projecting beyond an outermost extent of said wing; and said second fastener is a set of two buckles aligned with said set of clips and attached to said exterior surface, said buckles project beyond an outermost extent of said other of said wings.

18. The portable rollup pack as set forth in claim 1 wherein:

at least one of said fasteners is adjustable for accommodating a variety of cylindrical dimensions of rolled up sleeping bags.

19. A portable rollup pack adapted to be wrapped around a sleeping bag rolled into a cylindrical configuration, comprising:

an elongated, flexible, substantially rectangular bag body having a medially disposed storage section on an inwardly facing side of said bag body and a support region on an opposing exterior side of said bag body;

a pair of wings extending from said medially disposed storage section and including a secondary storage section, said wings adapted to be wrapped about a sleeping bag;

a plurality of compartments spanning a substantial length of said inwardly facing side of said bag body in said medially disposed storage section and said secondary storage section and including openings with closures parallel to at least one side of said bag body, at least one of said compartments being constructed from a substantially waterproof material and having a viewing window;

a pair of complementary fasteners adapted to secure said wings to one another about a sleeping bag; and a pair of spaced apart shoulder straps connected to said support region for carrying said bag body as a backpack.

* * * * *